US005988643A

United States Patent [19]

Awada

[11] Patent Number: 5,988,643

[45] Date of Patent: Nov. 23, 1999

[54] MULTI-ACTION CARD GAME FOR A CASINO

[76] Inventor: Yehia Awada, 3982 Roundwood St., Las Vegas, Nev. 89117

[21] Appl. No.: 09/019,036

[22] Filed: Feb. 5, 1998

[51] Int. Cl.[6] ..... A63F 1/00

[52] U.S. Cl. ..... 273/292

[58] Field of Search ..... 273/292, 274; 463/12, 13

[56] References Cited

U.S. PATENT DOCUMENTS

| | | | |
|---|---|---|---|
| 5,265,882 | 11/1993 | Malek | 273/292 |
| 5,377,993 | 1/1995 | Josephs | 273/292 |
| 5,639,092 | 6/1997 | Macaisa | 273/292 |

*Primary Examiner*—Benjamin H. Layno
*Attorney, Agent, or Firm*—Leonard Weiss

[57] ABSTRACT

A game is played on a generally semicircular top surface of a table that carries markings that define five wagering areas bounded by the markings and an arcuate edge of the surface. Each of the wagering areas carries three circular indicia therein. The game is started by a player placing checks representative of a High Card wager, a Black Jack wager and a Poker wager, respectively, upon the three indicia of a wagering area. The player and the dealer are each dealt a first card face up. The player wins the high card wager when the rank of the player's first card is higher than the rank of the dealer's first card. A second card is dealt face up to the player and face down to the dealer, whereby the dealer and the player each have two cards of a Modified Black Jack holding. The Black Jack wager is resolved in a manner similar to the way a Black Jack wager is resolved in the prior art with the exceptions that neither the dealer nor the player may receive more than five additional cards and the player may not go down for double. After the Black Jack wager is resolved, the player and the dealer receive additional cards until each holds seven cards. The player wins the poker wager when the player's holding includes a five card poker hand that is higher than any five card poker hand included in the dealer's holding.

15 Claims, 1 Drawing Sheet

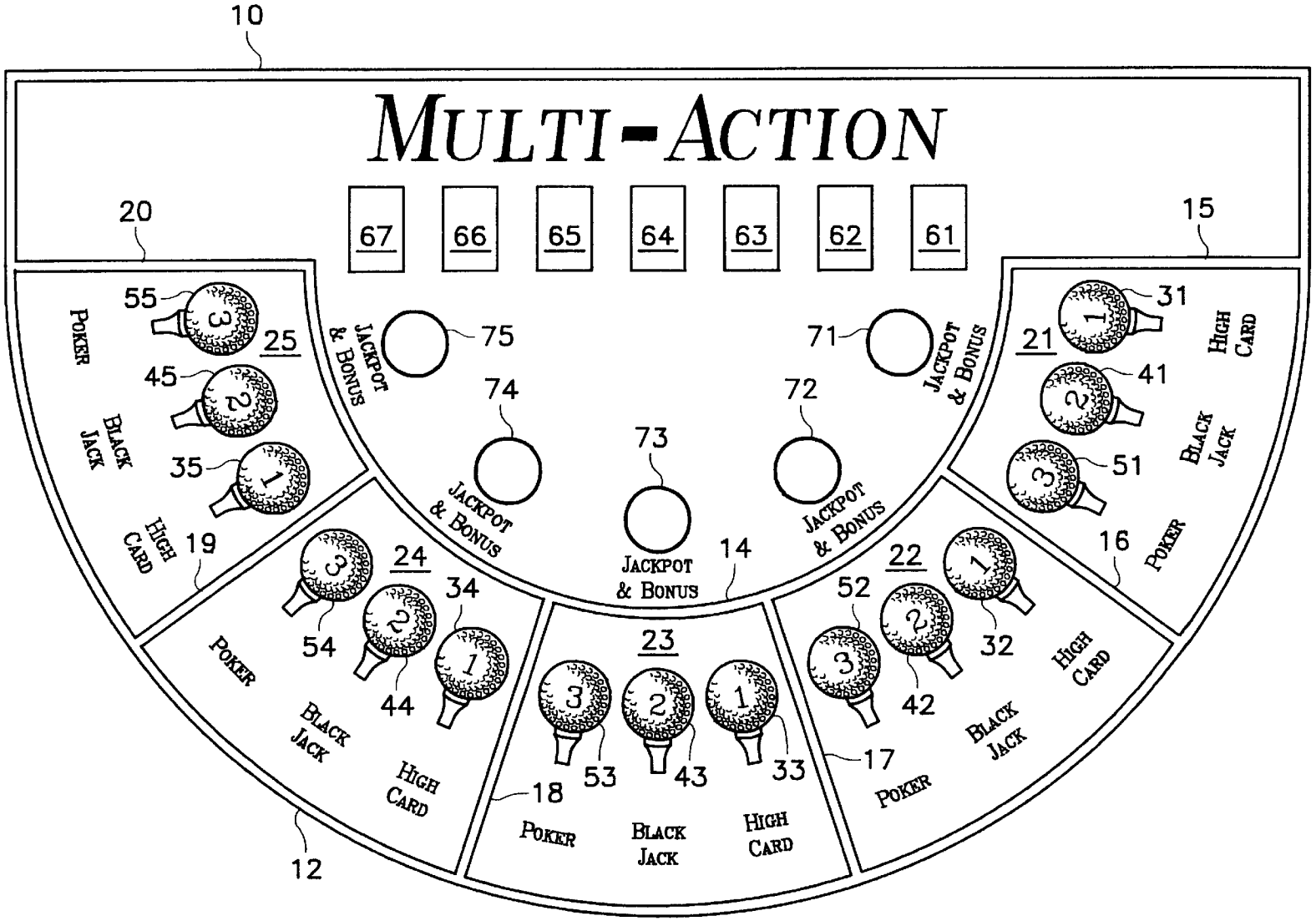
MULTI-ACTION
10
12
14
15
16
17
18
19
20
21
22
23
24
25
31
32
33
34
35
41
42
43
44
45
51
52
53
54
55
61
62
63
64
65
66
67
71
72
73
74
75
POKER
BLACK JACK
HIGH CARD
JACKPOT & BONUS

MULTI-ACTION CARD GAME FOR A CASINO

BACKGROUND OF THE INVENTION

1. Field of Invention

This invention is in the general field of casino gaming and, more particularly, is a method of simultaneously playing a plurality of card games in a casino.

2. Description of the Prior Art

Efforts to attract patrons to a casino include offering opportunities to play two of the most popular card games in the world. One of the card games is Poker; the other is Black Jack. More recently, the patrons have been offered an opportunity to play a card game called War.

Poker is the most frequently played card game in the United States. A player in a Poker game is permitted to wager against all other players in the Poker game that he holds a Poker hand that is superior to Poker hands respectively held by the other players.

An invariant feature of almost all Poker games is that a Poker hand is comprised of five cards. The value of the Poker hand is determined by its rank. The player with the highest ranking Poker hand is usually the winner. The rankings of Poker hands, in descending order, are given as:

ROYAL FLUSH, (Ace, King, Queen, Jack and 10 of the same suit);

STRAIGHT FLUSH, (five cards in sequence in any suit, i.e. Jack, 10, 9, 8, 7, of the same suit);

FOUR OF A KIND, (four Aces is highest);

FULL HOUSE, (THREE OF A KIND plus a PAIR, i.e., 10, 10, 10, King King);

FLUSH (Five cards of the same suit);

STRAIGHT (five cards in sequence but of different suits, i.e., (Jack, 10, 9, 8, 7);

THREE OF A KIND (Three cards of the same rank, i.e., three Aces);

TWO PAIRS (i.e., two Kings and two 10's);

ONE PAIR (two 5's); and

NO PAIR.

When Poker hands of equal rank are compared, rankings of cards comprising the Poker hands determine the highest rank. Thus, for example, a Poker hand that comprised of a pair of 10's has a higher rank than a Poker hand that is comprised of a pair of 9's.

The casino usually tries to promote games of the type where the player makes wagers against the casino rather than against the other players. By having the player wager against the casino there is an increase in the casino's revenue. Accordingly, Poker is not a game that casino management regards as highly desirable.

Black Jack is a game where one or more players make wagers against the casino. Accordingly, Black Jack is a game that the casino management regards as highly desirable.

An essential feature of a Black Jack game is that values are assigned to the cards. An ace is valued at a count of either 1 or 11 at the discretion of a player who is dealt the ace. When the dealer is dealt the ace, it is valued at the count of either 1 or 11 in accordance with rules of the casino which are described hereinafter.

Kings queens and jacks (referred to as court cards) are valued at a count of 10. All other cards are valued at a count that equals their face value.

The Black Jack game begins with each player making a wager. After the wagers are made, the dealer deals one card, face up, to each of the players and to himself. The dealer next deals another card, face up, to each of the players and one card face down to himself.

When the dealer's face-up card is an ace, a ten or a court card, the dealer must look at his face-down card. When the dealer's two cards have a total count of 21 (known as a natural 21), it is announced to the players. A player holding a natural 21 is permitted to retrieve his Black Jack wager. All other players lose their Black Jack wagers.

When the dealer does not hold a natural 21, a player to the extreme left of the dealer plays first. When the first player holds a natural 21 he wins his Black Jack wager.

When the first player does not hold a natural 21, he may:

1. receive a dealt card face up when he wants to increase the count of his holding. The first player may choose to receive additional dealt cards until he is either satisfied with the count of his holding or the count of his holding exceeds 21 (known as a bust). When the first player's hand is not a bust, he has an active holding.

2. choose not to receive any additional cards because he is either satisfied with the count of his holding or believes that an additional card would cause his holding to be a bust.

When the first player's holding is a bust, he loses his Black Jack wager and his holding is inactive. All other players may either draw cards or not as described in connection with the first player.

After all of the players have either received additional cards or chosen not to receive additional cards, and there is at least one player with an active holding, the dealer turns up the face-down card. When the dealer's holding has a count of 16 or less, the dealer is required to deal himself an additional card and continue to deal himself additional cards until the dealer's final holding exceeds 16. When the dealer's final holding is a bust, the player with the active holding wins his Black Jack wager.

When the dealer's holding has a count that exceeds 16, the dealer may not receive an additional card. It should be understood that when the dealer's holding includes an ace that, when valued at a count of 11, causes the dealer's holding to exceed the count of 16, the dealer may not receive an additional card.

The player with the active holding wins his Black Jack wager when the active holding has a count that exceeds the count of the dealer's final holding. Correspondingly, the player with the active holding loses his Black Jack wager when the active holding has a count that is less than the count of the dealer's final holding. When the count of the active holding equals the count of the dealer's holding, there is what is known as a push, whereby the player with the active holding is permitted to retrieve his Black Jack wager.

When, for example, the first player's holding is initially comprised of two cards with the same count, the player is said to hold a pair. In what is known as splitting the pair, the first player may treat each of the two cards as a first dealt card in two separate holdings. In a similar manner, all other players may split pairs.

In what is referred to as going down for double, the first player, for example, after receiving the initial two card holding may choose to double his Black Jack wager and receive only one additional card. In a similar manner, all other players may go down for double.

In war, after a player makes a high card wager, the dealer and the player are each dealt a card. When the player's card has a higher rank than the dealer's card, the dealer wins the high card wager. Correspondingly, when the player's card does not have a higher rank than the dealer's card, the player loses the high card wager.

It should be appreciated that Poker, Black Jack and War have features that differ from each other that attract the casino patron. Accordingly, it is not unusual for the casino patron to go from a Poker game to a Black Jack game or from a Poker game to a game of War. Accordingly, there is a need for a game that combines features of Poker, Black Jack and war.

SUMMARY OF THE INVENTION

An object of the present invention is to provide a game that includes features that attract a Poker player, a Black Jack player and a person who plays war in a casino.

According to a first aspect of the present invention, a generally semi-circular playing surface carries markings that define a wagering area bounded by the markings and an arcuate edge of the surface. The wagering area has three circular indicia therein that are carried in an alignment that is parallel to an arcuate edge of the surface. The surface additionally carries a plurality of similar rectangular indicium in an alignment parallel to a straight edge of the surface.

According to a second aspect of the present invention, a player initially makes three wagers that include high card wager, a Black Jack wager and a Poker wager. A first card is dealt face up to the player and face up to the dealer. The player wins the High Card wager when the rank of the player's first card is higher than the rank of the dealers first card.

A second card is dealt to the player face up and to the dealer face down whereby the player and the dealer each have two cards of a Modified Black Jack holding. When the dealer holds a natural 21, the Black Jack wager is either lost or may be retrieved as in the prior art. When the dealer does not hold a natural 21, the player is permitted to receive up to five additional cards in an attempt to acquire an active final Modified Black Jack holding that has an increased count that is not a bust. When an additional card causes the player's hand to be a bust the player's final Modified Black Jack holding is inactive whereby the player loses his Black Jack wager.

When the player has an active holding, the dealer is required to receive up to five additional cards in an attempt to achieve a dealer's final Black Jack holding with a count of at least 17 without becoming a bust. The player with the active holding wins the Black Jack wager when the dealer's final holding either has a count of less than 17, a count less than the count of the active holding or is a bust.

The player and the dealer each receive additional cards until they each have a holding of seven cards. The player wins the Poker wager when the player's seven card holding includes a five card Poker hand that has a higher rank than the rank of any five card Poker hand included in the dealer's seven card holding.

The invention includes a game with features that are associated with the games of Poker, Black Jack and War. Because of its features, it is a type of game that many casino patrons, including sophisticated casino patrons, should find attractive.

Other objects, features, and advantages of the invention should be apparent from the following description of the preferred embodiment thereof as illustrated in the accompanying drawing.

BRIEF DESCRIPTION OF THE DRAWING

The sole FIGURE herein is a plan view of a playing surface whereon a game is played in accordance with the invention.

DESCRIPTION OF THE PREFERRED EMBODIMENT

As shown in the drawing, a game in accordance with the present invention is played on a semi-circular top surface of a table. The surface has a straight edge 10 and an arcuate edge 12. A dealer (not shown) is usually positioned adjacent to the surface near the center of the edge 10.

The surface carries an arcuate line 14 that is parallel to the edge 12 and radial lines 15–20 that connect the edge 12 and the line 14. As explained hereinafter, the edge 12 and the lines 14–20 form enclosures of five wagering areas.

More particularly, the edge 12 and the lines 14–16 form an enclosure of a first wagering area 21. In a similar manner, the edge 12 and the lines 14, 16, 17 form an enclosure of a second wagering area 22; the edge 12 and the lines 14, 17, 18 form an enclosure of a third wagering area 23; the edge 12 and the lines 14, 18, 19 form an enclosure of a fourth wagering area 24; the edge 12 and the lines 14, 19, 20 form an enclosure of a fifth wagering area 25.

Preferably, a first player is positioned near the surface adjacent to the wagering area 21. In a similar manner, second, third, fourth and fifth players are preferably positioned adjacent to the wagering areas 22–25, respectively.

The surface carries an indicium 31 within the wagering area 21 adjacent to the line 15. The indicium 31 is a likeness of a golf ball, with a lettering of the numeral, 1, thereon, that rests upon a golfing tee. The tee is oriented to have its central axis substantially perpendicular to the edge 12.

Because the indicium 31 is a likeness of a golf ball that rests upon a tee, it is a symbol of affluence that could be expected to attract affluent gaming patrons. Additionally, lettering of the words, HIGH CARD, is carried on the surface, disposed in a space between the edge 12 and the indicium 31.

The surface carries indicia 32–35, that are similar to the indicium 31, within the wagering areas 22–25, respectively. Moreover, the indicia 32–35 are respectively adjacent to the lines 16–20 with their orientations similar to the orientation of the indicium 31.

It should be understood that the indicia 31–35 are in an alignment that is parallel to the edge 12. Lettering of the words, HIGH CARD is carried within the wagering areas 22–25 with a disposition that corresponds to the disposition described in connection with the indicium 31.

The surface carries an indicium 41 within the wagering area 21 midway between the lines 15, 16. The indicium 41 is similar in appearance and orientation to the indicium 31 with the exception that a lettering of the numeral, 2, is carried thereon instead of the lettering of the numeral, 1. Additionally, lettering of the words, BLACK JACK, is carried on the surface, disposed in a space between the edge 12 and the indicium 41.

The surface carries indicia 42–45, that are similar to the indicium 41, within the wagering areas 22–25, respectively. Moreover, the indicia 42–45 are respectively midway between the lines 16, 17, the lines 17, 18, the lines 18, 19 and the lines 19, 20 with their orientations similar to the orientation of the indicium 31.

It should be understood that the indicia 41–45 are in the alignment that is parallel to the edge 12. Lettering of the words, BLACK JACK is carried within the wagering areas 22–25 with a disposition that corresponds to the disposition described in connection with the indicium 41.

The surface carries an indicium 51 within the wagering area 21 adjacent to the line 16. The indicium 51 is similar in appearance and orientation to the indicium 31 with the exception that a lettering of the numeral, 3, is carried thereon instead of the lettering of the numeral, 1. Additionally, lettering of the word, POKER, is carried on the surface, disposed in a space between the edge 12 and the indicium 51.

The numerals 1, 2 and 3 indicate the order of resolution of the player's High Card wagers, Black Jack wagers and Poker wagers. More particularly, High Card wagers are resolved first, Black Jack wagers are resolved second and Poker wagers are resolved last. The wagers are described hereinafter.

The surface carries indicia 52–55, that are similar to the indicium 51, within the wagering areas 22–25, respectively. Moreover, the indicia 52–55 are respectively adjacent to the lines 16–20 with their orientations similar to the orientation of the indicium 31.

It should be understood that the indicia 51–55 are in the alignment that is parallel to the edge 12. Lettering of the words, BLACK JACK is carried within the wagering areas 22–25 with a disposition that corresponds to the disposition described in connection with the indicium 51.

The surface additionally carries rectangular card placement indicia 61–67 that are slightly larger than a playing card. The indicia 61–67 are in an alignment parallel to the edge 10. Additionally, the surface carries lettering of the word, MULTI-ACTION, on a space between the indicia 61–67 and the edge 10.

The game is initiated by the first, second, third, fourth and fifth players placing cheques representative of wagers upon the indicia 31, 41, 51, the indicia 32, 42, 52, the indicia 33, 43, 53, the indicia 34, 44, 54, the indicia 35, 45, 55, respectively. The cheques placed upon the indicia 31–35, the indicia 41–45 and the indicia 51–55 are respectively referred to as High Card wagers, Black Jack wagers and Poker wagers.

It should be understood that the cheques placed by the first player upon the indicia 31, 41, 51 are respectively representative of equal amounts of money. Similarly, the three wagers of each of the other players are for equal amounts of money.

After each of the players has made the three wagers, a first card is dealt by the dealer face up to each of the players. The first, second third, fourth and fifth player's first cards are placed within the wagering areas 21–25, respectively. Additionally, the dealer deals himself a first card that is placed face up within the indicia 61. The players' and dealer's first cards are used in a resolution of the High Card wagers.

The first player wins his High Card wager when the rank of the first player's first card is higher than the rank of the dealer's first card. The first player receives a one to one payout from the dealer when he wins his High Card wager.

The first player loses his High Card wager when the rank of the first player's first card is less than or equal to the rank of the dealer's first card. High Card wagers of all of the other players are resolved in a similar manner.

After the High Card wagers are resolved, a second card is dealt by the dealer face up to each of the players. The first, second, third, fourth and fifth player's second cards are placed within the wagering areas 21–25, respectively. Additionally, the dealer deals himself a second card that is placed face down within the indicia 62. Accordingly, the players and the dealer each have two cards of a Modified Black Jack holding. The outcome of the second wager is resolved as described hereinafter.

When the dealer holds a natural 21, the Black Jack wagers are either lost or may be retrieved as in the prior art. When the dealer not hold the natural 21, and the first player holds a natural 21, the first player wins his Black Jack wager.

When neither the dealer nor the first player hold a natural 21, the first player is permitted to receive up to five additional cards in an attempt to acquire an active final Modified Black Jack holding that has an increased count that is not greater than 21.

When an additional card causes the first player's hand to be a bust, the first player's final Modified Black Jack holding is inactive. A player with the inactive holding loses his Black Jack wager.

It should be understood that all of the first player's cards are placed within the wagering area 21. All other players may either draw cards or not as described in connection with the first player.

In the Modified Black Jack game, a player may go down for double as in the prior art. However, unlike the prior art, a player may not split pairs.

After all of the players have either received additional cards or chosen not to receive additional cards, and there is at least one player with an active holding, the dealer turns up the face-down card within the indicium 62.

When the dealer's holding has a count of less than 17, the dealer is required to deal himself up to five additional cards in an attempt to achieve a final holding with a count of at least 17 without becoming a bust. When the dealer cannot achieve the final holding with the count of at least 17 or the dealer's holding is a bust, the player with the active holding wins his Black Jack wager.

The dealer's additional cards are placed within the indicia 63–67. When, for example, the dealer deals himself three additional cards, they are placed within the indicium 63, 64, 65, respectively.

As in the prior art, when the dealer's final holding has a count that exceeds 16, the dealer may not receive an additional card. Additionally, when the dealer's holding includes an ace that, when valued at a count of 11, causes the dealer's holding to exceed the count of 16, the dealer has a final holding and may not receive an additional card.

When the dealer's final holding is not a bust and has a count that exceeds 16, the count of the final holding and the count of the active holding are compared. The player with the active holding wins his Black Jack wager when the active holding has a count that exceeds the count of the dealer's final holding. Correspondingly, the player with the active holding loses his Black Jack wager when the active holding has a count that is less than the count of the dealer's holding. When the count of the active holding equals the count of the dealer's holding, there is what is known as a push, whereby the player with the active holding retrieves his Black Jack wager.

After the outcome of the Black Jack wager is resolved, cards are dealt to the first player until seven cards have been placed within the wagering area 21. Thus, for example, when the first player is dealt four cards in connection with the High Card and the Black Jack wagers, the first player is dealt three additional cards. Additional cards are dealt to the second, third, fourth and fifth players until seven cards have been placed within each of the wagering areas 22–25. Similarly, additional cards are dealt to the dealer until seven cards have been placed within the indicia 61–67, respectively.

When each of the players and the dealer each have seven cards, the first player's seven cards are compared to the dealer's seven cards. The first player wins the Poker wager when the player's holding includes a five card Poker hand that is higher than any five card Poker hand included in the dealer's holding. All of the other players win their Poker wager in a similar manner. A player who wins a Poker wager receives a one to one payout from the dealer.

Preferably, the players are permitted to contribute to a jackpot and bonus pool. Contributions are made to the pool and payouts are made therefrom in a manner that is described hereinafter.

A circular jackpot and bonus indicium 71 is carried on the surface outside of the wagering area 21 in a radial alignment with the indicia 51. Additionally, the surface carries lettering of the words, JACKPOT AND BONUS in a space between the line 14 and the indicium 71.

In a similar manner, indicia 72–75 are carried on the outside of the working areas 22–25 in radial alignment with the indicia 52–55, respectively. Lettering of the words, JACKPOT AND BONUS, is similarly carried on the surface in spaces between the line 14 and the indicia 72–75.

At the initiation of the game, the first, second, third, fourth and fifth players are permitted to contribute to a bonus and jackpot pool by placing cheques representative of a predetermined amount of jackpot money within the indicia 71–75, respectively. When a player's seven cards includes a Poker hand with a rank of four of a kind or higher, a bonus is paid from the pool to the player.

When a player contributes to the pool and holds seven cards that includes a Poker hand with a rank of four of a kind or higher and the dealer's Poker hand has a higher rank than the rank of the player's Poker hand, 75% of the pool is given to the player. 25% of the pool is divided among other players in the game who have contributed to the pool. In other words, the game includes what is known in the gaming industry as a bad beat jackpot.

In a first alternative embodiment, when the players and the dealers receive their seven cards, they form Pai Gow Poker hands which are evaluated to determine the winners of the Poker wagers.

In a second alternative embodiment, the players only play for a High Card wager and a Black Jack wager.

In a third alternative embodiment, the players only play for a Black Jack wager and a Poker wager.

While the invention has been particularly shown and described with reference to a preferred embodiment thereof, it should be understood by those skilled in the art that changes in form and detail may be made therein without departing from the spirit and scope of the invention.

I claim:

1. A method of playing a game comprising the steps of:

providing one standard deck of playing cards;

a High Card wager, a Black Jack wager and a Poker wager being made by a player;

dealing a first card to said player;

dealing a first card to a dealer;

resolving said High Card wager by making a High Card payout to said player when said player's first card has a higher rank than the rank of said dealer's first card;

dealing a second card to said player, whereby said player has two cards of a modified Black Jack holding;

dealing a second card to said dealer whereby said dealer has two cards of a modified Black Jack holding;

optionally dealing additional cards to said player and dealing additional cards to said dealer if required, according to the rules of Black Jack, and comparing the player's Black Jack holding with the dealer's Black Jack holding;

resolving said Black Jack wager:

said player remaining in the game regardless of the player's result in Black Jack;

dealing additional cards to said player until said player has a holding of seven cards;

dealing additional cards to said dealer until said dealer has a holding of seven cards;

comparing the player's seven card holding with the dealer's seven card holding according to the rules of poker; and resolving said poker wager.

2. In the method of claim 1 wherein said step of resolving said Black Jack wager includes said dealer winning said Black Jack wager when said dealer's holding is a natural 21 and said player does not hold a natural 21.

3. In the method of claim 1 wherein said step of resolving said Black Jack wager includes said player winning said Black Jack wager when said player's holding is a natural 21 and said dealer does not hold a natural 21.

4. In the method of claim 1 wherein said step of resolving said Black Jack wager includes permitting said player to retrieve said Black Jack wager when said dealer and said player each have a holding that is a natural 21.

5. In the method of claim 1 wherein said dealer does not hold a natural 21, said step of resolving said Black Jack wager including permitting said player to receive up to five additional cards until said player either has an active holding with a count that said player does not choose to increase or said player's holding is a bust.

6. In the method of claim 5 wherein said step of resolving said Black Jack wager includes said player losing said Black Jack wager when said player's holding is a bust.

7. In the method of claim 5 wherein said step of resolving said Black Jack wager includes requiring said dealer to receive up to five additional cards to achieve a final dealer's Black Jack holding with a count of at least 17 without becoming a bust when said player has the active holding.

8. In the method of claim 7 wherein said step of resolving said Black Jack includes comparing said player's active holding with said dealer's final holding, said player winning said Black Jack wager when said active holding has a count that exceeds the count of said dealer's final holding.

9. In the method of claim 7 wherein said step of resolving said Black Jack wager includes said player winning said Black Jack wager when said dealer receives five additional cards and has a count of less than 17.

10. In the method of claim 1, wherein said step of resolving said Black Jack wager includes the additional step of said dealer making a one to one payout to said player when said player wins said Black Jack wager.

11. In the method of claim 1, the additional step of permitting said player to go down for double when said player receives said second card and said dealer does not hold a natural 21.

12. In the method of claim 1 wherein said step of resolving said Poker wager includes comparing said player's seven cards to said dealer's seven cards, said player winning said Poker wager when said player's seven cards includes a five card Poker hand that has a higher rank than a five card poker hand included in said dealer's seven cards.

13. In the method of claim 1, the additional steps of:

forming Pai Gow Poker hands by said player from said player's seven cards;

forming Pai Gow Poker hands by said dealer from said dealer's seven cards; and determining a winner of said Poker wager from said Pai Gow hands.

14. In the method of claim 1, the additional steps of:

permitting said player to contribute to a bonus and jackpot pool; and paying said player a bonus from said pool when said player contributes to said pool and said player's seven cards includes a Poker hand with a rank of four of a kind or higher.

15. In the method of claim 14, the additional step of paying said player 75% of said jackpot pool when said player contributes to said pool and said player's seven cards both includes a Poker hand with a rank of four of a kind or higher and said dealer's Poker hand has a higher rank than the rank of the player's Poker hand, 25% of said pool being divided among other players in the game who contribute to said pool.

* * * * *